United States Patent [19]

Snelling

[11] Patent Number: 4,801,967

[45] Date of Patent: Jan. 31, 1989

[54] VOLTAGE SENSING IN A.C. COROTRONS

[75] Inventor: Christopher Snelling, Penfield, N.Y.

[73] Assignee: Xerox Corporation, Stamford, Conn.

[21] Appl. No.: 124,228

[22] Filed: Nov. 23, 1987

[51] Int. Cl.[4] ..... G03G 15/02; H01T 19/00

[52] U.S. Cl. ..... 355/3 CH; 355/14 CH; 250/325

[58] Field of Search ..... 355/14 CH, 3 CH, 3 R, 355/14 R; 250/324, 325, 326

[56] References Cited

U.S. PATENT DOCUMENTS

| | | | |
|---|---|---|---|
| 3,604,925 | 9/1971 | Snelling | 250/49.5 ZC |
| 4,074,134 | 2/1978 | Roalson | 250/324 |
| 4,431,302 | 2/1984 | Weber | 355/14 CH |
| 4,456,370 | 6/1984 | Hayes, Jr. | 355/14 CH |
| 4,585,323 | 4/1986 | Ewing et al. | 355/3 CH |
| 4,618,249 | 10/1986 | Minor | 355/14 CH |
| 4,634,259 | 1/1987 | Oishi et al. | 355/3 CH X |
| 4,695,723 | 9/1987 | Minor | 250/325 |
| 4,699,499 | 10/1987 | Hoshika et al. | 355/3 CH |

*Primary Examiner*—A. C. Prescott

*Attorney, Agent, or Firm*—Mark Costello

[57] ABSTRACT

A voltage measuring device in an electrostatographic arrangement having a photoreceptor member charged to a uniform voltage level prior to imagewise discharge, and including at least a first corotron having a corona producing coronode driven with an A.C. voltage source for neutralizing charge on a surface in the electrostatographic arrangement. A thin conductive wire electrode is arranged parallel and across the photoreceptor surface and parallel to the coronode, to derive a current proportional to the voltage on the photoreceptor surface. Voltage measurements may be taken as a known function of the current derived in the electrode.

7 Claims, 3 Drawing Sheets

VOLTAGE SENSING IN A.C. COROTRONS

The present invention relates generally to voltage sensing devices, and more particularly to a voltage sensing device linearly responsive to the voltage of a photoreceptor in an electrophotographic device.

INCORPORATION BY REFERENCE

U.S. Pat. No. 3,604,925 to Snelling is herein incorporated by reference.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharaged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways.

It is common practice in electrophotography to use corona generating devices to provide electrostatic fields driving various machine operations. Thus, corona devices are used to deposit charge on the charge retentive surface or photoreceptor prior to exposure to light, to implement toner transfer from the photoreceptor surface to the substrate, to neutralize charge on the substrate for removal from the photoreceptor surface, and to assist cleaning of the photoreceptor surface after toner has been transferred to the substrate. These corona devices normally incorporate at least one coronode held at a high voltage to generate ions or charging current to charge a surface closely adjacent to the device to a uniform voltage potential, and may contain screens and other auxiliary coronodes to regulate the charging current or control the uniformity of charge deposited.

A number of corona devices are driven with an A.C. voltage potential. For example, in the Xerox 9500 duplicator, A.C. driven corotrons, corona charging devices comprising a bare wire coronode held between insulating end blocks and surrounded by a conductive housing usually held at a ground potential, are used at pre-transfer, detack, and pre-clean stations.

Dicorotrons, A.C. driven corona charging devices provided with a dielectric coated coronode and a control electrode or shield, are noted for the capability of charging a surface to the potential of the shield. In the Xerox 1090 copier, a tandem pair of dicorotrons operate to charge the photoreceptor surface preparatory to exposure. In that arrangement, a first dicorotron charges the surface with a known A.C. voltage applied to the coronode and a known D.C. voltage applied to the shield. A second dicorotron is also driven with an A.C. voltage and a shield voltage. Any difference between the surface voltage, as applied by the first dicorotron, and the shield voltage of the second dicorotron causes a shield current in the second dicorotron which is related to the difference. This shield current is useful in a feedback arrangement that may be used to control the first dicorotron shield voltage. U.S. Pat. No. 4,456,370 to Hayes, Jr. demonstrates a feedback arrangement using such a combination.

Scorotrons, which may be A.C. driven corona charging devices, are characterized by a conductive screen or grid interposed between a coronode and photoreceptor surface, and held at a voltage corresponding to the desired charge on the photoreceptor surface. A D.C. voltage is applied to the scorotron grid. The grid tends to share the corona current with the photoreceptor surface. As the voltage on the photoreceptor surface increases towards the voltage level of the grid, corona current flow to the grid is increased, until all the the corona current flows to the grid and no further charging of the photoreceptor surface takes place. U.S. Pat. No. 4,074,134 to Roalson appears to show a scorotron charging device, D.C. in this case, where the voltage on the screen is used to derive a signal for comparison to a reference to control the high voltage corona power source. JP-A No. 59-228678 shows a similar arrangement.

In U.S. Pat. No. 3,604,925 to Snelling et al., an arrangement is described for a D.C. corotron in which a bare wire electrode is positioned adjacent the device to detect a portion of the corona curret ($i_s$) attracted to the shield. The current detected by the bare wire electrode is related to the surface potential ($V_p$) potential on the charged surface. However, this relationship is only linear over a relatively small voltage range, and thus provides only limited utility. Similar arrangements are shown by JP-A No. 60-107051, and U.S. Pat. No. 4,431,302 to Weber.

In the Xerox 9500 copier, photoreceptor residual potential cycle-up has the effect of changing the development/cleaning fields, and thus the copying characteristics. The magnitude of these fields depends upon the relationship between photoreceptor surface potential and developer roll bias. It would be highly desirable to measure the photoreceptor surface potential to derive a feedback control of the developer roll bias to maintain a constant relationship between the development/cleaning fields and photoreceptor.

SUMMARY OF THE INVENTION

In accordance with the invention, there is provided a voltage sensor for use adjacent to an A.C. corotron which has an improved range of voltage following characteristics in comparison with prior art devices. An A.C. corotron, provided with a bare coronode wire tautly strung between insulating end blocks, and partially surrounded with a grounded conductive shield, is driven to a corona producing condition with an A.C. high voltage source. A bare wire electride is used as a voltage sensor, supported closely adjacent, and preferably interior to the shield. The electrode uses corona or ion current scavenged in the proximity of the coronode as a measure of the surface potential of the photoreceptor. Similar to the charge limiting function of the scorotron, where the corona current to the screen increases in magnitude as the photoreceptor surface potential approaches the voltage on the screen, the corona current scavenged by the electrode in the inventive A.C. voltage measuring device is proportional to the charge on the photoreceptor surface. The result is a current in the electrode measurable by standard current measuring techniques, from which photoreceptor surface potential measurements may be made. While U.S. Pat. No. 3,604,925 to Snelling et al. demonstrates a similar arrangement with respect to a D.C. driven corotron, an unobvious and surprisingly improved result is noted when the arrangement is used in an A.C. driven corotron. The relationship between the detected corona current scavenged by the wire electrode and the photoreceptor surface potential is noted to be linear over a significantly larger range of voltages than had been previously noted with respect to the D.C. driven case. This linearity creates a heretofore unknown usefulness for the arrangement.

In accordance with another aspect of the invention, a voltage measurement arrangement is described which provides a linear response to photoreceptor surface voltage and which is also placement independent until the signal to noise ratio of the detected current renders the signal immeasurable.

These and other aspects of the invention will become apparent from the following description used to illustrate a preferred embodiment of the invention read in conjunction with the accompanying drawings in which:

FIG. 1 schematically shows a voltage measurement device in accordance with the present invention;

Figure 1:
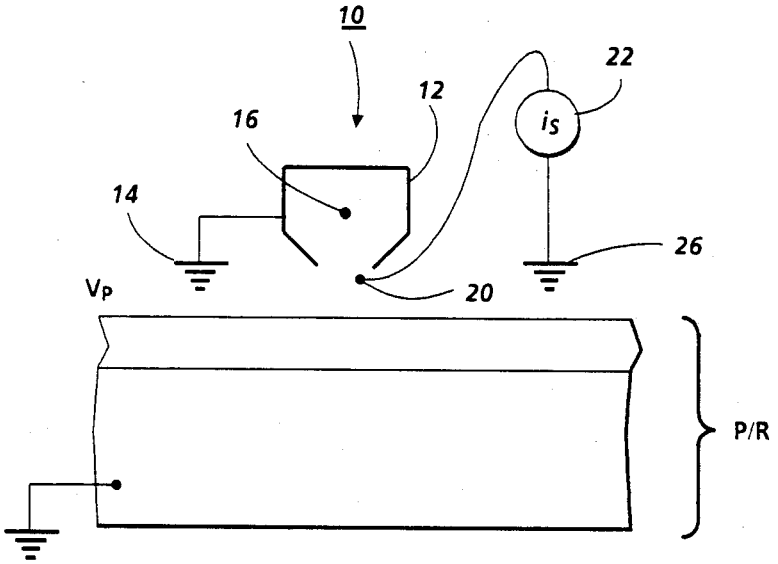
Figure 2:
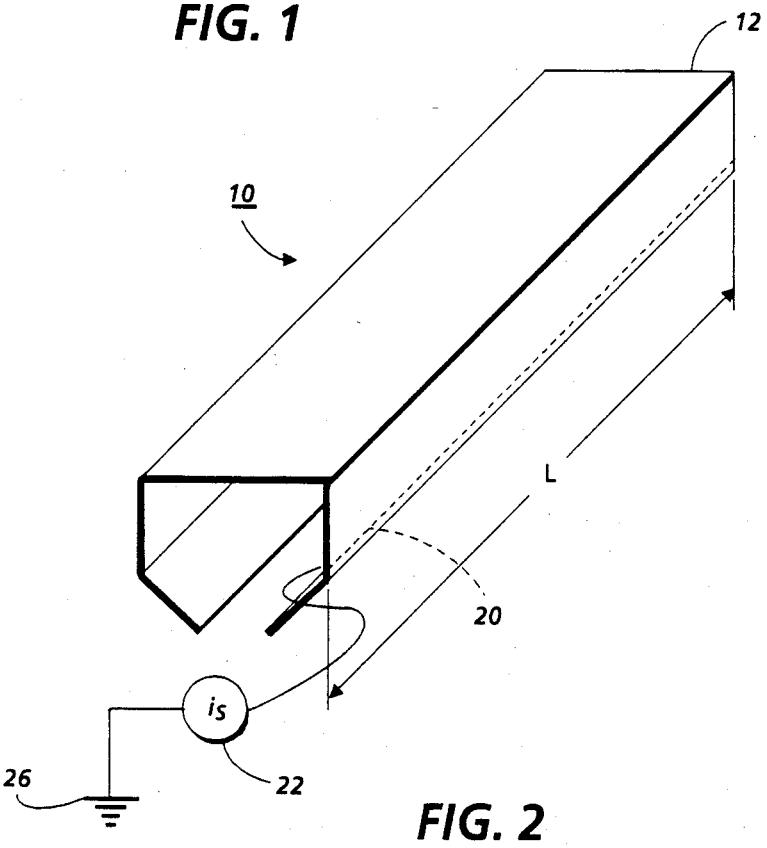
FIG. 2 shows a perspective view of a voltage measurement device.

Referring now to the drawings where the showings are for the purpose of describing a preferred embodiment of the invention and not for the purpose of limiting same, FIGS. 1 and 2 show an A.C. corotron for use in an electrophotographic reproduction device, such as that typically used for pre-transfer, detack, and preclean stations. A.C. corotrons are used to partially neutralize charge on a surface. For example, A.C. corotrons have use in a pre-transfer step, partially neutralizing the charge on toner supported on the the photoconductive surface prior to transfer; in a detack operation, partially neutralizing charge on the paper causing the paper to tack to the photoconductive surface prior to removal from contact with the photoconductive surface; and in a pre-cleaning step to partially neutralize the charge on the toner causing it to cling to the photoconductive surface. Corotron 10 is generally comprised of a conductive shield 12, connected to a ground 14, supported closely adjacent to a photoreceptor P/R to be exposed to ions generated by the device. A bare wire coronode 16 extends through the interior of shield 12 along the length L thereof, and is connected to A.C. high voltage source 18 operating in the range of 7–10 kilovolts, peak to peak. In cross-section, shield 12 is is commonly a conductive metal U-shaped member, generally having three enclosed sides and open to face the surface to be charged, although other shapes are possible. Corotron 10 includes a pair of insulating end blocks (not shown) supporting th corotron with respect to photoconductive surface P/R and the reproduction device assembly, and providing an electrical contact between coronode 16 and A.C. high voltage source 18, shown in FIG. 1 only schematically. Other shield and coronode shapes and configurations are possible, such as for example, a semicircular shield with an open section adjacent the surface to be charged, or a pin array coronode. A.C. corotrons as described are well known to those skilled in the art.

In accordance with the invention, a voltage sensing device is provided with a fine wire electrode 20, supported near shield 12 of corotron 10 for the detection of voltage on a surface to be charged, such as photoreceptor P/R or a sheet of paper upon which an image will be made. Wire electrode 20 may extend parallel to coronode 16, for the length L of shield 12, or a significant portion thereof. Increasing the length of the electrode with respect to the coronode increases the signal to noise ratio. Electrode 20 is a conducting metallic material suitable for withstanding the corona environment in which it is placed. In one working embodiment, electrode 20 was an 18″×0.040″ diameter steel piano wire. Placement of electrode 20 may vary, and while in the described preferred embodiment, electrode 20 is located interior to shield 12, it is an advantage of this invention as compared to that described in U.S. Pat. No. 3,604,925 to Snelling et al., that the current derived by the electrode is proportional to the voltage on the photoreceptor surface. Electrode 20 is located within the path of corona current from the coronode 16 to photoconductive surface P/R. As the electrode is moved to a position exterior to the shield, the signal to noise ratio decreases until the signal is no longer useful. For use as an electrometer, a standard current measuring device 22 measures the scavenged current $i_s$ between the portion of the electrode supported at the shield 12 and ground connection 26.

As in a scorotron charging arrangement, corona current is divided between the surface to be charged and the grounded shield member, with the current to the shield increasing as the charge on the surface increases. The wire electrode in the present invention scavenges a portion of the ions normally directed to the shield, and a current $i_s$ is thereby derived in the electrode for measurement by current measurement device 22. No noticeable effect on the charging operation of the device is noted when the electrode is added to the corotron arrangement.

Figure 3:
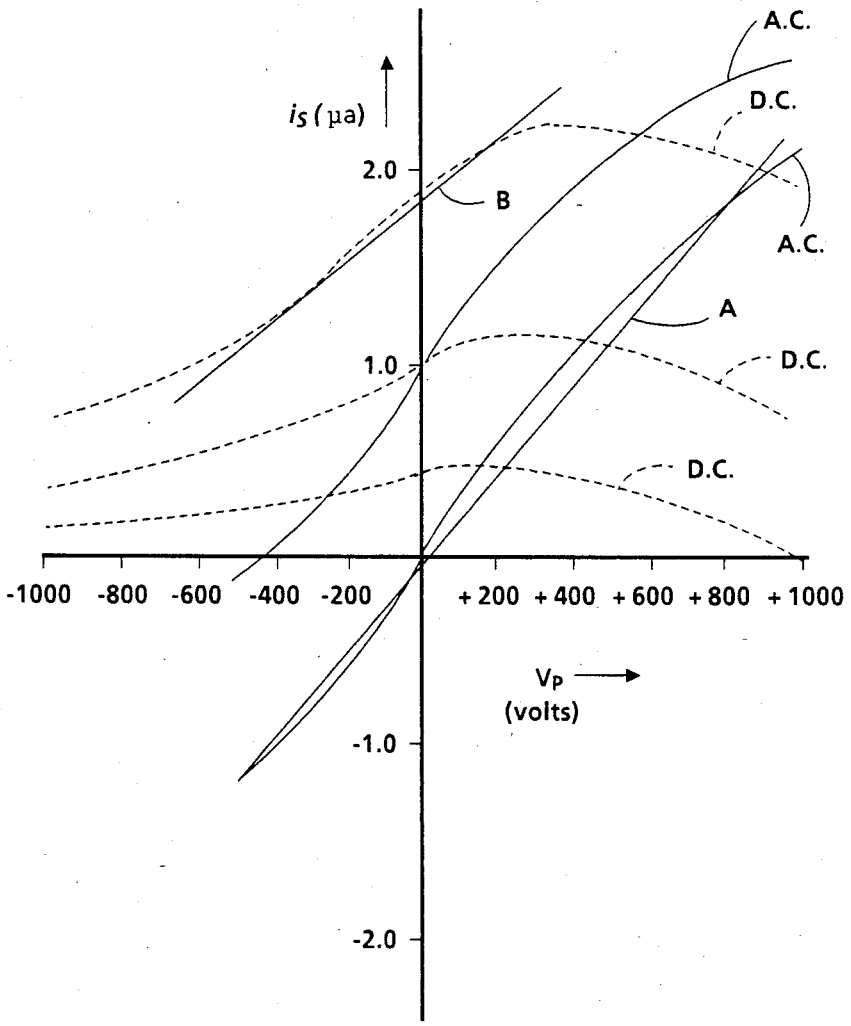
FIG. 3 shows comparison of scavenged current versus photoreceptor voltage for comparable D.C. and A.C. corotrons.

As shown in FIG. 3 by the curves labeled A.C., the novel voltage sensing device produces a linearly responsive current signal $i_s$ proportional to the voltage $V_p$ on photoreceptor P/R. $I_s$ (corona current derived by the wire) is approximately linearly proportional to $V_p$ over a range of approximatley 1500 volts (−500 to +1000V), as demonstrated by line A overlaid on one of the A.C. curves. By comparison, for the curves labeled D.C., demonstrating the signal response of the same arrangement in use with respect to a D.C.corotron, substantially as described in U.S. Pat. No. 3,604,925 to Snelling, is linear over a much smaller range of 700 volts (−400 to 300V), as demonstrated by the line B overlaid on one of the D.C. curves. The present invention demonstrates an approximately two fold improvement in linearity which allows a usefulness over a significantly larger range of values.

Figures 4, 5:
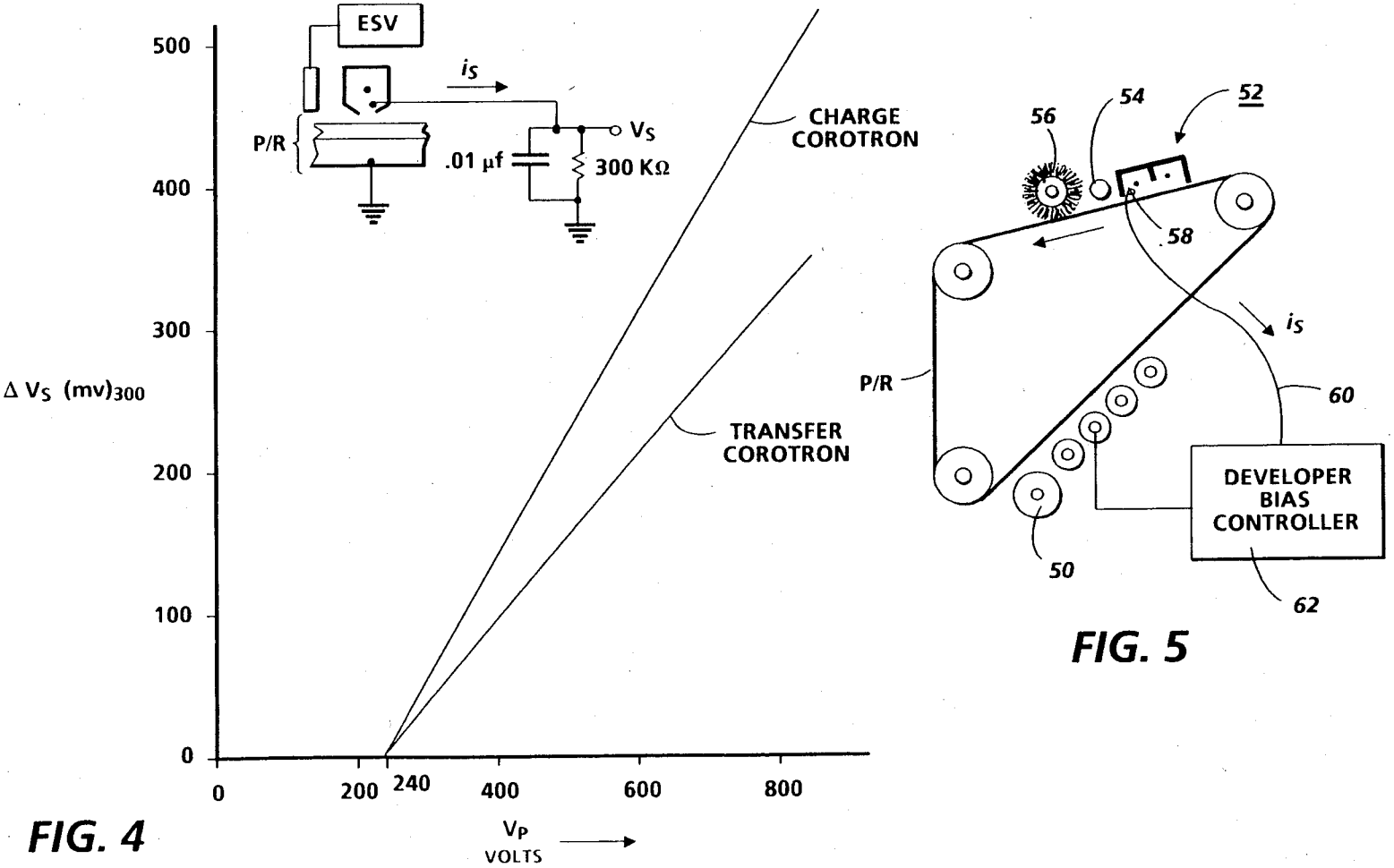
FIG. 4 shows a comparison of the results derived from measured photoreceptor surface potential and the inventive voltmeter arrangement.
FIG. 5 shows a schematic view of of a xerographic copying arrangement in which the inventive voltage sensing device is used to create a feedback signal to the developer bias controller to control developer bias as a function of photoreceptor voltage.

With reference now to FIG. 4, an empirical comparison of the measurements with the inventive voltage sensing arrangement and an industry standard electrostatic voltmeter, Trek Model No. 3601 was made for pre-clean and pre-transfer corotrons in the Xerox 9500 copier. Reviewing the graph, it may be seen that the increase in signal voltage $V_s$ (i.e., $\Delta V_s$) was linear with measured photoreceptor surface potential ($V_p$). In this experiment, $V_s$ was the voltage drop across a 300 kΩ resistor due to the current $i_s$ flowing to ground. $V_s$ was measured with a digital voltmeter having high ($10^7\Omega$) input impedance. The graph shows that $\Delta V_s$ increased monotonically with increasing values to photoreceptor surface potential. The measurements were made in a diagnostic mode of operation without development. Thus, in comparison to standard voltage measurement devices, the measurements produce very good results.

With reference now to FIG. 5, a potential application of the inventive voltage measurement device is shown schematically for a Xerox 9500 type copier. As is well known, electrostatic latent images on photoreceptor P/R are developed at development station 50 where several electrically biased developer rolls bring toner into contact with the photoreceptor to develop latent images thereon. Subsequent to transfer of the image to a substrate, toner remaining on photoreceptor P/R is removed therefrom at a cleaning station including a pre-clean corotron 52, erase lamp 54 for neutralizing charge on the toner and the photoreceptor, respectively and cleaning brush 56 for removing the toner. As noted previously, photoreceptor residual potential cycle-up, i.e, potential building up on the photoreceptor despite neutralizing by the pre-clean corotron, has the effect of changing development and cleaning fields and hence copy characteristics. Magnitude of these fields depends upon the photoreceptor surface potential and developer roll bias. Feedback control of developer roll bias may maintain constant development or cleaning fields based upon photoreceptor surface potential measurement with the inventive voltage measuring arrangement. Accordingly, the addition of electrode 58 in the area immediately adjacent pre-clean corotron 52 derives a current $i_s$ in wire 60, which provides a feedback signal proportional to the photoreceptor surface potential to developer bias control 62 for the control of the developer bias. Control of the developer bias may then be in accordance with any standard control techniques.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

I claim:

1. In an electrostatographic device, having a photoreceptor member charged to a uniform voltage level prior to imagewise discharge thereof, and including at least a first corotron having a corona producing coronode driven with an A.C. voltage source supported therein, for neutralizing charge on a surface, and a conductive shield substantially surrounding the coronode, and open on a side adjacent to the photoreceptor surface, a surface potential measuring device comprising:

a thin conductive wire electrode arranged parallel and across the photoreceptor surface, parallel to the coronode, and adjacent to the shield which derives a current proportional to the voltage on the photoreceptor surface.

2. The device as defined in claim 1 wherein said conductive wire electrode is supported interior to the shield.

3. The device as defined in claim 1 wherein the conductive wire electrode extends substantially the length of the coronode.

4. In an electrostatographic device, having a photoreceptor member charged to a uniform level of voltage prior to imagewise discharge thereof, and subsequent development of the image on the member with toner at a developing station by a developer arrangement applying a voltage bias to an development electrode arranged adjacent and across the photoreceptor member at the developing station, said device including:

at least a first corona producing device driven with an A.C. voltage source, for neutralizing charge on the photoreceptor member subsequent to imagewise discharge, including a coronode supported parallel and across the photoreceptor surface and a conductive shield substantially surrounding the coronode, and open on a side adjacent to the photoreceptor surface;

a thin conductive wire electrode arranged parallel and across the photoreceptor surface, parallel to the coronode, and closely adjacent the conductive shield, which derives a current proportional to the voltage on the photoreceptor surface; and feedback control means for controlling the voltage level bias of developer electrode in accordance with the current derived by said electrode.

5. The device as defined in claim 1 wherein said conductive wire electrode is supported interior to said shield.

6. The device as defined in claim 1 wherein said conductive wire electrode extends substantially the length of said coronode.

7. A method for measuring voltage on a surface in an electrostatographic device, having a photoreceptor member charged to a uniform level of potential prior to imagewise discharge by exposure to light, and subsequent development of the image on said photoreceptor member with toner at a developing station by a developer arrangement applying a voltage level bias to a developer electrode arranged adjacent and across said photoreceptor member at said developing station, including at least a first corotron driven with an A.C. voltage source, for neutralizing charge on a surface, said corotron including a coronode supported parallel and across the photoreceptor surface between insulating end blocks and having a conductive shield substantially surrounding the coronode, and open on a side adjacent to the photoreceptor surface, including the steps of:

placing a bare wire electrode in a position proximate and parallel to said A.C. driven coronode and said surface, adjacent to said shield;

measuring a current in said electrode derived from its proximity to the coronode and photoconductive member;

using said current as a proportional measure of voltage on the surface of said photoconductive member and controlling the voltage level bias to a developer electrode in accordance therewith.

* * * * *